US006699033B2

(12) United States Patent
Xu

(10) Patent No.: US 6,699,033 B2
(45) Date of Patent: Mar. 2, 2004

(54) PIEZOELECTRIC LIGHTER FOR CIGAR, PIPE, AND CIGARETTE

(76) Inventor: Wen Xu, Rm. 405, 3rd.Building, Henghenanzincun, Wenzhou, Zhejiang (CN)

( * ) Notice: Subject to any disclaimer, the term of this patent is extended or adjusted under 35 U.S.C. 154(b) by 0 days.

(21) Appl. No.: 10/313,988

(22) Filed: Dec. 5, 2002

(65) Prior Publication Data

US 2003/0129556 A1 Jul. 10, 2003

Related U.S. Application Data

(63) Continuation-in-part of application No. 09/798,766, filed on Mar. 2, 2001, now abandoned.

(51) Int. Cl.[7] ..... F23Q 7/12

(52) U.S. Cl. ..... 431/255; 431/280; 431/281; 431/344

(58) Field of Search ..... 431/344, 255, 431/280, 281, 278, 129, 130, 132

(56) References Cited

U.S. PATENT DOCUMENTS 5,308,240 A * 5/1994 Lowenthal ..... 431/131
5,584,681 A * 12/1996 Suzuki ..... 431/132
6,152,725 A * 11/2000 Lee ..... 431/266

FOREIGN PATENT DOCUMENTS

| | | | |
|---|---|---|---|
| DE | 42 34 489 | * 5/1993 | |
| GB | 2 259 755 | * 3/1993 | |
| JP | 406109247 | * 4/1994 | |
| JP | 10-160161 | * 6/1998 | ..... F23Q/2/16 |
| WO | WO 92/22772 | * 12/1992 | |

* cited by examiner

*Primary Examiner*—Carl D. Price
(74) *Attorney, Agent, or Firm*—Raymond Y. Chan; David and Raymond Patent Group

(57) ABSTRACT

A piezoelectric lighter includes a gas emission arrangement including a pair of jet nozzles and a gas emitting tube communicating with a liquefied gas storage respectively, a gas releasable valve extended from the liquefied gas storage for controlling a flow of gas to the gas emission arrangement, a pair of gas ejecting conduits connected from the gas releasable valve to the two jet nozzles respectively, and a gas ejecting duct connected from the gas releasable valve to the gas emitting tube. Therefore, the piezoelectric lighter is adapted for selectively producing either a pair of jet flames at the same time when the gas discharged to the two jet nozzles through the gas ejecting conduits or producing a visible flame when the gas discharged to the gas emitting tube through the gas ejecting duct.

9 Claims, 4 Drawing Sheets

PIEZOELECTRIC LIGHTER FOR CIGAR, PIPE, AND CIGARETTE

CROSS REFERENCE OF RELATED APPLICATION

This is a Continutation-In-Part application of a non-provisional application, application No. 09/798,766, filed Mar. 2, 2001, now abandoned.

BACKGROUND OF THE PRESENT INVENTION

1. Field of Invention

The present invention relates to piezoelectric lighters, and more particularly to a piezoelectric lighter which can provide a pair of jet flames and a visible flame for selectively lighting cigar, pipe and cigarette. Thus, the piezoelectric lighter comprises two jet nozzles adapted for producing double jet flames at the same time so as to increase a burning area of the piezoelectric lighter.

2. Description of Related Arts

Piezoelectric lighters have been known and sold throughout the world. A conventional piezoelectric lighter comprises a single gas emitting nozzle for producing either a jet flame or a visible flame. It is known that a visible flame type piezoelectric lighter, such as a conventional cigarette lighter, provides a general temperature visible flame that fits for lighting up a cigarette or a cigar to a void an emitting gas from the lighter to destroy the taste of the tobacco. However, the jet flame type piezoelectric lighter, which comprises an ignition element, produces a high temperature jet flame, wherein the ignition element is adapted for maintaining a high temperature adequate to re-ignite the emitting gas so as to provide a windproof function for the lighter. Smokers always have a conflict to choose the visible flame type lighter in order to keep the taste of the cigarette or the jet flame type lighter for conveniently. Pipe smokers will more concern the flame to light up the high quality of tobacco.

Moreover, since the jet flame type piezoelectric lighter is more powerful than the visible flame type piezoelectric lighter, the jet flame type piezoelectric lighter employs more gas to produce the stronger jet flame. In order to increase the flaming ability, the flow of emitting gas must be increased for ignition. However, the flame does not getting stronger proportionally because the emitted gas is not completely burnt, which is a waste of gas. Thus, the single gas emitting nozzle can only provide a limited burning area which is the area of the flame can reach.

SUMMARY OF THE PRESENT INVENTION

A main object of the present invention is to provide a piezoelectric lighter for cigar, pipe, and cigarette wherein the piezoelectric lighter is adapted for selectively producing either a pair of jet flames or a visible flame.

Another object of the present invention is to provide a piezoelectric lighter for cigar, pipe, and cigarette wherein the piezoelectric lighter comprises two jet nozzles for producing double jet flames at the same time so as to increase a burning area while being gas employed effectively.

Another object of the present invention is to provide a piezoelectric lighter for cigar, pipe, and cigarette, wherein the operation of the piezoelectric lighter requires one single continuous motion for selectively producing the jet flames or the visible flame, which is advantageous in practical use.

Accordingly, in order to accomplish the above objects, the present invention provides a piezoelectric lighter for cigar, pipe, and cigarette, which comprises:

a casing having a liquefied gas storage;

a gas emission arrangement comprising a pair of jet nozzles and a gas emitting tube communicating with the liquefied gas storage respectively;

a gas ejecting arrangement comprising a gas releasable valve extended from the liquefied gas storage for controlling a flow of gas to the gas emission arrangement;

a lever arm disposed in the casing in a vertical movable manner having a lifting end engaged with the gas releasable valve and an engaging end arranged in such a manner that when the engaging end of the lever arm is lifted upwardly, the lifting end of the gas lever lifts up the gas releasable valve for releasing gas;

a piezoelectric unit, which is disposed in the casing for generating piezoelectricity, comprising a movable operating part extended upwardly and an ignition tip extended to a position closed to the gas emission arrangement in such a manner that when the movable operating part is depressed downwardly, spark is generated from the ignition tip to ignite a gas emitted from the gas emission arrangement at the same time;

an ignition button mounted on a ceiling of the casing in a vertical movable manner wherein the ignition button is attached to a top end of the piezoelectric unit and arranged in such a manner that when the ignition button is depressed downwardly, the movable operating part of the piezoelectric unit is depressed to ignite the piezoelectric lighter; and a lighter cap pivotally mounted on the ceiling of the casing in a movable manner wherein the lighter cap comprises a pivot arm extended to the engaging end of the gas lever and arranged in such a manner that when the lighter cap is pivotally flipped sidewardly to open, the pivot arm lifts up the engaging end of the lever arm for releasing gas.

DETAILED DESCRIPTION OF THE PREFERRED EMBODIMENT

Figure 1:
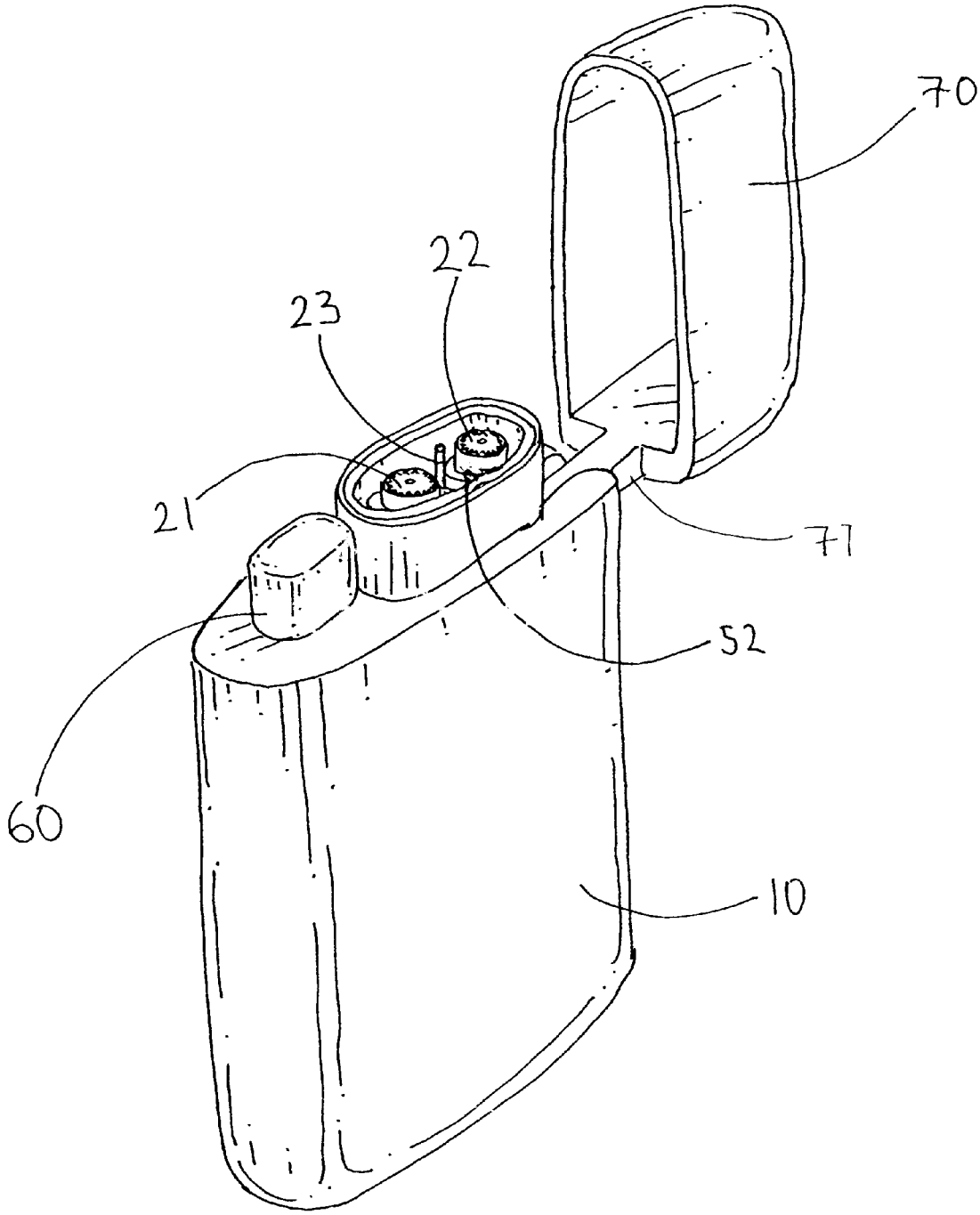
FIG. 1 is a perspective view of a piezoelectric lighter for cigar, pipe, and cigarette according to a preferred embodiment of the present invention.
Figure 2:
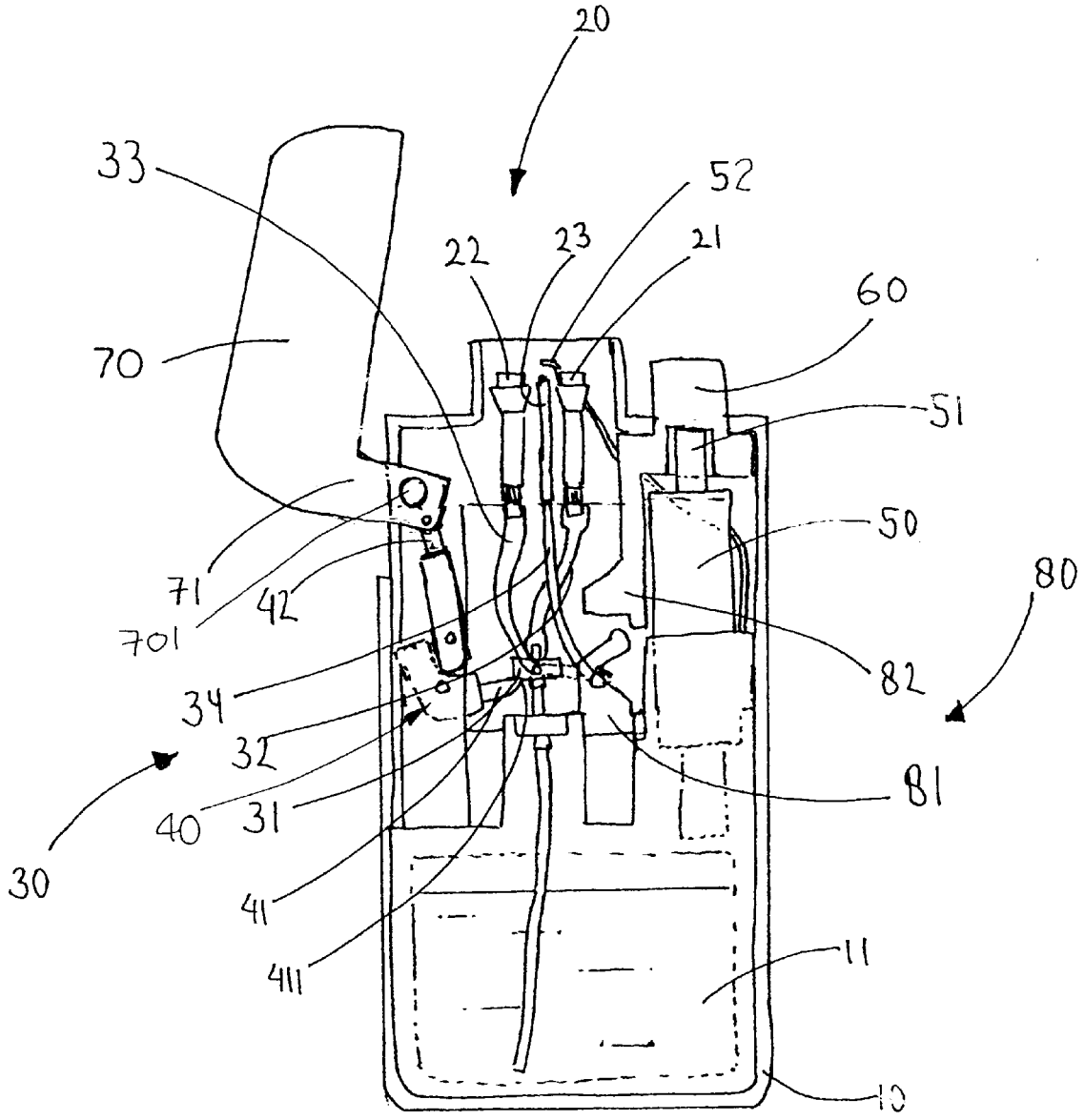
FIG. 2 is a sectional view of the piezoelectric lighter for cigar, pipe, and cigarette according to the above preferred embodiment of the present invention.

Referring to FIGS. 1 and 2 of the drawings, a piezoelectric lighter for cigar, pipe, and cigarette according to a preferred embodiment of the present invention is illustrated. The piezoelectric lighter comprises a casing 10 having a liquefied gas storage 11, a gas emission arrangement 20 comprising a pair of jet nozzles 21, 22 and a gas emitting tube 23 communicating with the liquefied gas storage 11 respectively, a gas ejecting arrangement 30 comprising a gas releasable valve 31 extended from the liquefied gas storage 11 for controlling a flow of gas to the gas emission arrangement 20.

A lever arm 40 is disposed in the casing 10 in a vertical movable manner, as shown in FIG. 2, having a lifting end 41 engaged with the gas releasable valve 31 and an engaging end 42 arranged in such a manner that when the engaging end 42 of the gas lever 40 is lifted upwardly, the lifting end 41 of the gas lever 40 lifts up the gas releasable valve 31 for releasing gas. Accordingly, the lever arm 40 has a tip 411 integrally extended from the lifting end 41 of the lever arm 40, wherein the tip 411 is biased against a bottom of the gas releasable valve 31 to lift up the gas releasable valve 31.

The piezoelectric lighter further comprises a piezoelectric unit 50, an ignition button 60, and a lighter cap 70.

The piezoelectric unit 50, which is disposed in the casing 10 for generating piezoelectricity, comprises a movable operating part 51 extended upwardly and an ignition tip 52 extended to a position closed to the gas emission arrangement 20 in such a manner that when the movable operating part 51 is depressed downwardly, spark is generated from the ignition tip 52 to ignite a gas emitted from the gas emission arrangement 20 at the same time.

The ignition button 60 is mounted on a ceiling of the casing 10 in a vertical movable manner wherein the ignition button 60 is attached to a top end of the piezoelectric unit 50 and arranged in such a manner that when the ignition button 60 is depressed downwardly, the movable operating part 51 of the piezoelectric unit 50 is depressed to ignite the piezoelectric lighter.

The lighter cap 70 is pivotally mounted on the ceiling of the casing 10 in a movable manner about an operation axle 701 provided in the casing 10, as shown in FIG. 2, wherein the lighter cap 70 comprises a pivot arm 71 extended to couple with the engaging end 42 of the lever arm 40 and arranged in such a manner that when the lighter cap 70 is flipped sidewardly, the pivot arm 71 lifts up the engaging end 42 of the gas lever 40 for releasing gas. In other words, in a normal position, the gas releasable valve 31 blocks the gas releasing from the liquefied gas storage 11 until the lighter cap 70 is pivotally flipped to open with respect to the casing 10.

According to the preferred embodiment, the two jet nozzles 21, 22 are upwardly extended to the ceiling of the casing 10 in a parallel manner, wherein the gas emitting tube 23 is also upwardly extended to the ceiling of the casing 10 and positioned between the two jet nozzles 21, 22 in such a manner that the ignition tip 52, which is extended to a position closed to the jet nozzles 21, 22 and the gas emitting tube 23, generates spark to ignite the emitted gases from the jet nozzles 21, 22 for producing jet flames and from the gas emitting tube 23 for producing a visible flame.

Figure 3B:
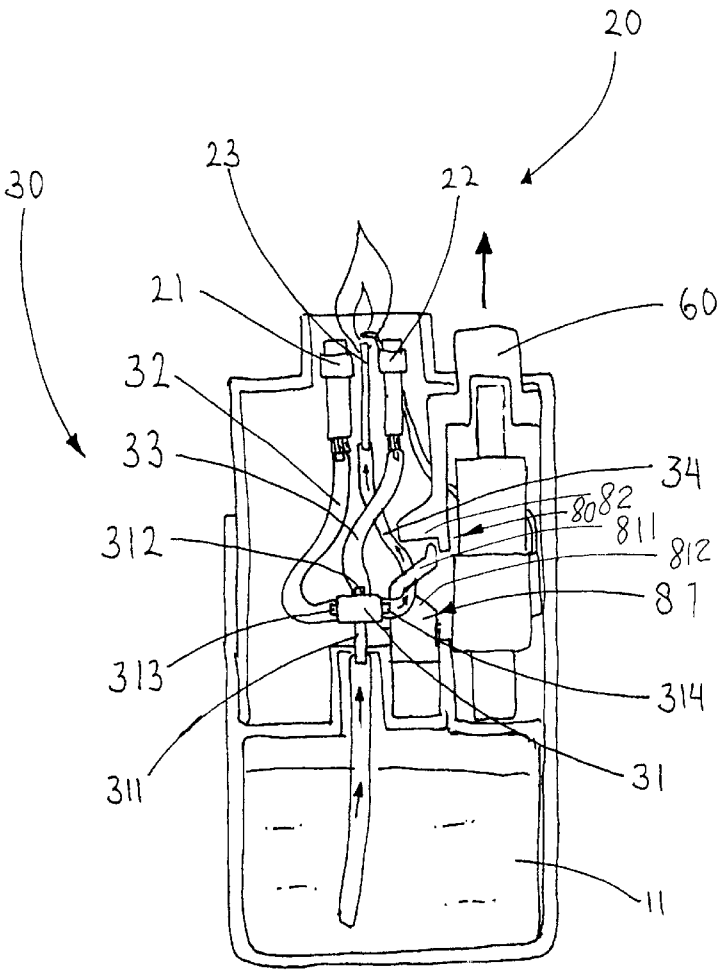
FIG. 3B is a partially sectional view of the piezoelectric lighter producing a visible flame according to the above preferred embodiment of the present invention.
Figure 3A:
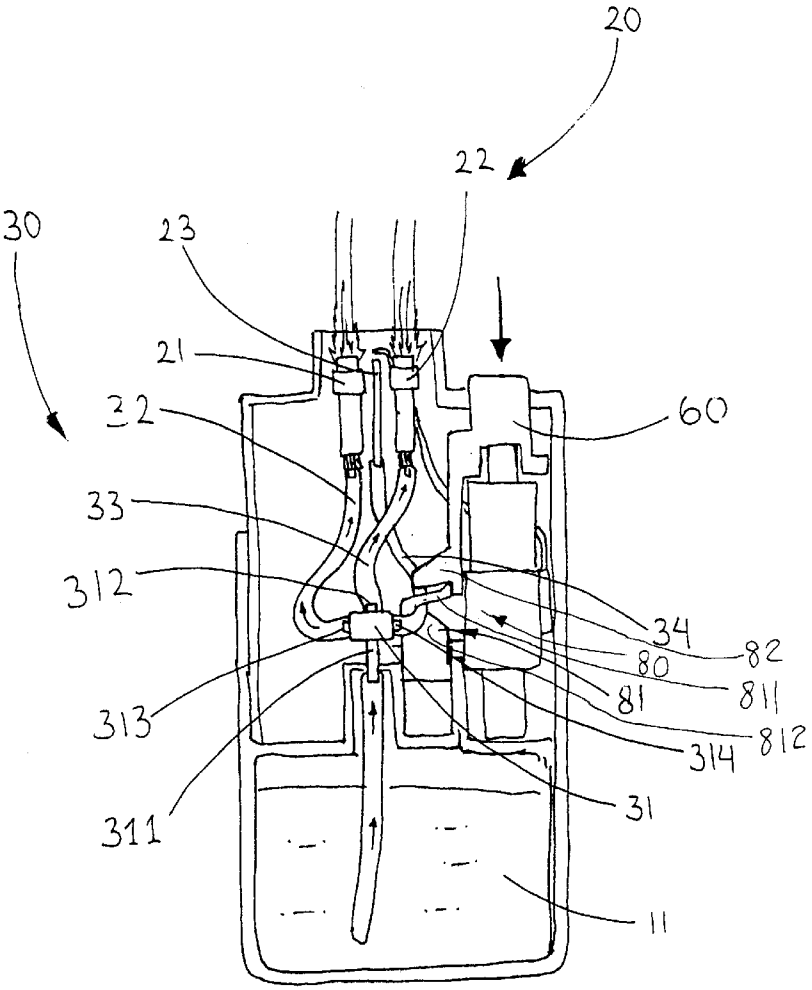
FIG. 3A is a partially sectional view of the piezoelectric lighter producing a jet flame according to the above preferred embodiment of the present invention.

As shown in FIGS. 2, 3A and 3B, the gas ejecting arrangement 30 further comprises a pair of gas ejecting conduits 32, 33 connected from a first and a second outlet 312, 313 of the gas releasable valve 31 to the two jet nozzles 21, 22 respectively and a gas ejecting duct 34 connected from a third outlet 314 of the gas releasable valve 31 to the gas emitting tube 23. Furthermore, the gas releasable valve 31 has an inlet 311 downwardly extended from the liquefied gas storage 11, while the first, second and third outlets 312, 312, 314 are connected with the gas ejecting duct 34 and the gas ejecting conduits 32, 33 and the gas ejecting duct 34 respectively.

Both the gas ejecting conduits 32, 33 and the gas ejecting duct 34 are preferably made of flexible material such as plastic such that the gas ejecting conduits 32, 33 and the gas ejecting duct 34 are capable of compressing and bending to fittedly connect from the gas releasable valve 31 to the gas emission arrangement 20.

According to the present invention, the diameter of the nozzle pore of each of the jet nozzles 21, 22 is much smaller than the diameter of the gas emitting tube 23. Therefore, it is worth to mention that when the gas is normally discharged from the liquefied gas storage 11, the gas passes through the gas releasable valve 31 will directly flow to the gas ejecting duct 34 to emit through the gas emitting tube 23 to produce a visible flame, as shown in FIG. 3B. When the gas cannot pass through the gas ejecting duct 34, the gas will detour and discharge through the gas ejecting conduits 32, 33 to the two jet nozzles 32, 33 respectively for producing two jet flames, as shown in FIG. 3A.

As shown in FIGS. 3A, 3B, 4A, and 4B, the piezoelectric lighter further comprises a gas regulating means 80 for selectively detouring the emitted gas from the gas ejecting arrangement 30 to the gas emission arrangement 20 through the gas ejecting duct 34 or the gas ejecting conduits 32, 33. The gas regulating means 80 comprises a U-shaped locking member 81 supported in the casing 10 and securely holding the gas ejecting duct 34, and a depressible arm 82 downwardly extended from the ignition button 60 and arranged to be driven downwardly towards the locking member 81 when the ignition button 60 is depressed downwardly to compress the gas ejecting duct 34 for blocking the gas passing therethrough.

Figure 4B:
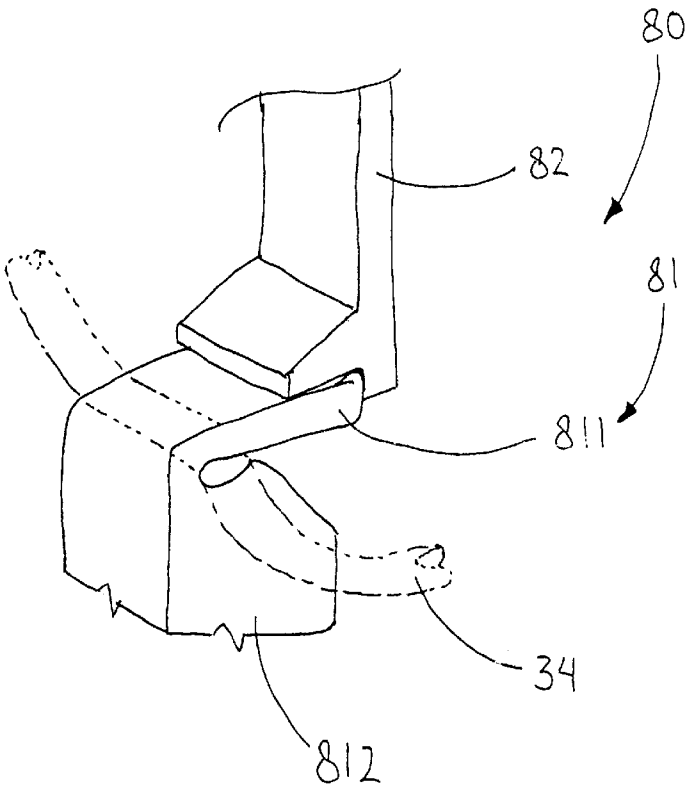
FIG. 4 is a partially perspective view of a gas regulating means of the piezoelectric lighter according to the above preferred embodiment of the present invention.
Figure 4A:
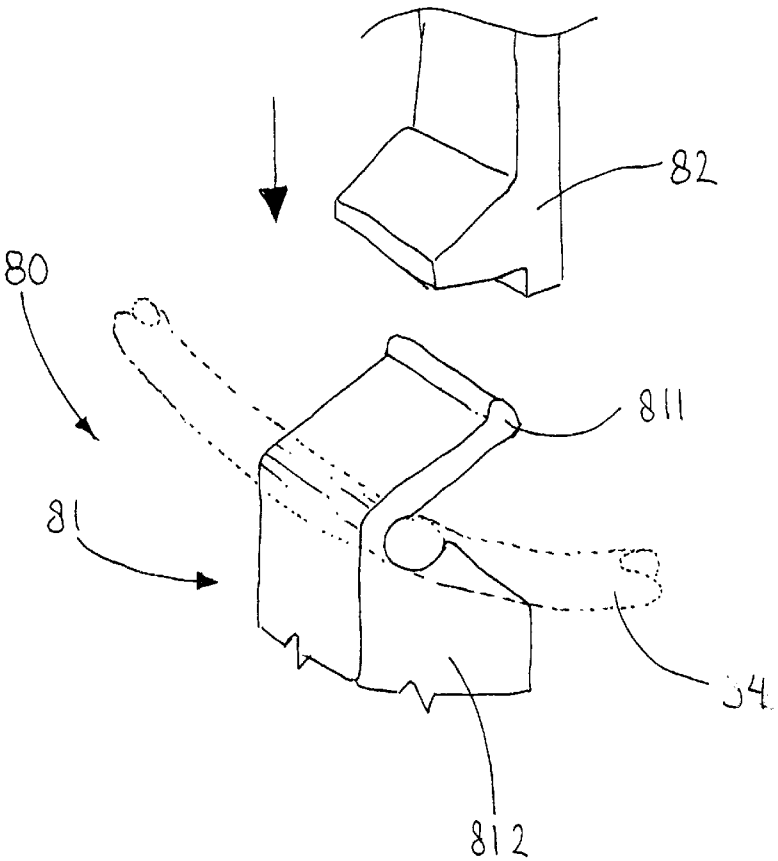

Accordingly, the locking member 81 comprises an upper elastic arm 811 and a lower arm 812 defining a V-shape groove therebetween, wherein the gas ejecting duct 34 is securely held between the upper elastic arm 811 and the lower arm 812, as shown in FIG. 4A, in such a manner that when the depressible arm 82 is driven downwardly to depress the upper elastic arm 811, the gas ejecting duct 34 is compressed for blocking any gas passing therethrough, as shown in FIG. 4B.

In order to ignite the piezoelectric lighter, the lighter cap 70 is pivotally flipped to open and lift up the engaging end 42 of the gas lever 40 for releasing gas from the liquefied gas storage 11. Then, a downward force must be intentionally applied on the ignition button 60 to compress the piezoelectric unit 50 for generating spark and to compress the gas ejecting duct 34 between the upper elastic arm 811 and the lower arm 812 to block any gas passing therethrough at the same time, as shown in FIGS. 3A and 4B, so that the gas discharged from the gas releasable valve 31 has to emit through the gas ejecting conduits 32, 33. Therefore, the spark generated from the ignition tip 52 ignites the emitted gases from the two jet nozzles 21, 22 through the gas ejecting conduits 32, 33, as shown in FIG. 3A. Once the downward force is released from the ignition button 60, the compression of the gas ejection duct 34 is released and the gas releasable valve 31 will automatically switch to discharge gas to the gas emitting tube 23 through the gas ejecting duct 34 for producing the visible flame, as shown in FIGS. 3B and 4A. In other words, the piezoelectric lighter provides the two jet flames when the ignition button 60 is pressed downward and the visible flame once the ignition button 60 is rebounded back to its original position. Once the lighter cap 70 is flipped back to its original closed position, the gas releasable valve 31 drops down to its original position so as to shut the gas releasing from the liquefied gas storage 11.

In view of the above disclosure of the preferred embodiment, it is apparent that the present invention can achieve the following advantages:

(1) The piezoelectric lighter can selectively produce either the pair of jet flames and the visible flame for lighting up a cigar, pipe, and cigarette according to a user's preference.

(2) The piezoelectric lighter can produce two jet flames at the same time so as to increase the burning area of the piezoelectric lighter.

(3) Since two flows of gas are evenly emitted from the two jet nozzles through the gas ejecting conduits respectively, the quantity of the jet flame will be double comparing with a conventional single jet flame piezoelectric lighter. Thus, the gas will be efficiently ignited from the jet nozzles to produce stronger jet flames so that no gas is wasted in the ignition process.

(4) The ignition process of the piezoelectric lighter only requires one single motion to selectively produce the jet flames or the visible flame for easy manipulation. In other words, the piezoelectric is advantageous in practical use.

What is claimed is:

1. A piezoelectric lighter, comprises:

a casing having a liquefied gas storage;

a gas emission arrangement comprising a pair of jet nozzles and a gas emitting tube communicating with said liquefied gas storage respectively;

a gas ejecting arrangement comprising a gas releasable valve extended from said liquefied gas storage for controlling a flow of gas to said gas emission arrangement, wherein said gas ejecting arrangement comprises two gas ejecting conduits connected from said gas releasable valve to said two jet nozzles and a gas ejecting duct connected from said gas releasable valve to said gas emitting tube;

a piezoelectric unit, which is disposed in said casing for generating piezoelectricity, comprising a movable operating part extended upwardly and an ignition tip extended to a position closed to said gas emission arrangement to generate spark to ignite a gas selectively emitted from either said jet nozzles and said gas emitting tube of said gas emission arrangement when said movable operating part is depressed downwardly; and a gas regulating means for selectively detouring said gas emitted from said gas ejecting arrangement to said gas emission arrangement through said gas ejecting duct or said gas ejecting conduits, wherein said gas regulating means comprises a locking member supported in said casing and securely holding said gas ejecting duct, a depressible arm arranged to be driven downwardly towards said locking member when said movable operating part is depressed to compress said gas ejecting duct for blocking said gas passing therethrough, wherein said locking member comprises an upper elastic arm and a lower arm and said gas ejecting duct is securely held between said upper elastic arm and said lower arm, wherein when said depressible arm is driven downwardly to depress said upper elastic arm to compress said gas ejecting duct between said upper elastic arm and said lower arm to block any of said gas from passing through said gas ejecting duct;

wherein when said movable operating part is depressed to generate said spark, said depressible arm is driven downwardly to depress said upper elastic arm to compress said gas ejecting duct between said upper elastic arm and said lower arm to block any of said gas from passing through said gas ejecting duct to said gas emitting tube, wherein said gas discharged from said gas releasable valve emits through said gas ejecting conduits and said jet nozzles so that said spark generated from said ignition tip ignites said gas emitted from said pair of jet nozzles to produce a pair of jet flames;

wherein once the compression of said gas ejecting duct between said upper elastic arm and said lower arm is released when said movable operating part and said depressible arm is upwardly return to an original position thereof, said gas discharged from said gas releasable valve flows through said gas ejecting duct to emit through said gas emitting tube so that said gas emitted from said gas emitting tube to produce a visible flame.

2. The piezoelectric lighter, as recited in claim 1, further comprising a lever arm, disposed in said casing in a vertical movable manner, having a lifting end engaged with said gas releasable valve and an engaging end arranged in such a manner that when said engaging end of said gas lever is lifted upwardly, said lifting end of said gas lever lifts up said gas releasable valve for releasing gas.

3. The piezoelectric lighter, as recited in claim 2, wherein said lever arm has a tip integrally extended from said lifting end to bias against a bottom of said gas releasable valve to lift up said gas releasable valve.

4. The piezoelectric lighter, as recited in claim 2, further comprising a lighter cap pivotally mounted on a ceiling of said casing in a movable manner, wherein said lighter cap comprises a pivot arm extended to said engaging end of said gas lever and arranged in such a manner that when said lighter cap is flipped sidewardly, said pivot arm lifts up said engaging end of said lever arm for releasing gas.

5. The piezoelectric lighter, as recited in claim 3, further comprising a lighter cap pivotally mounted on a ceiling of said casing in a movable manner, wherein said lighter cap comprises a pivot arm extended to said engaging end of said gas lever and arranged in such a manner that when said lighter cap is flipped sidewardly, said pivot arm lifts up said engaging end of said lever arm for releasing gas.

6. The piezoelectric lighter, as recited in claim 1, further comprising an ignition button mounted on a ceiling of said casing in a vertical movable manner wherein said ignition button is coupled with a top end of said movable operating part of said piezoelectric unit and arranged in such a manner that when said ignition button is depressed downwardly, said movable operating part of said piezoelectric unit is depressed to ignite said piezoelectric lighter.

7. The piezoelectric lighter, as recited in claim 2, further comprising an ignition button mounted on a ceiling of said casing in a vertical movable manner wherein said ignition button is coupled with a top end of said movable operating part of said piezoelectric unit and arranged in such a manner that when said ignition button is depressed downwardly, said movable operating part of said piezoelectric unit is depressed to ignite said piezoelectric lighter.

8. The piezoelectric lighter, as recited in claim 3, further comprising an ignition button mounted on a ceiling of said casing in a vertical movable manner wherein said ignition button is coupled with a top end of said movable operating part of said piezoelectric unit and arranged in such a manner that when said ignition button is depressed downwardly, said movable operating part of said piezoelectric unit is depressed to ignite said piezoelectric lighter.

9. The piezoelectric lighter, as recited in claim 4, further comprising an ignition button mounted on said ceiling of said casing in a vertical movable manner wherein said ignition button is coupled with a top end of said movable operating part of said piezoelectric unit and arranged in such a manner that when said ignition button is depressed downwardly, said movable operating part of said piezoelectric unit is depressed to ignite said piezoelectric lighter.

* * * * *